US009183837B2

(12) United States Patent
Lee

(10) Patent No.: US 9,183,837 B2
(45) Date of Patent: Nov. 10, 2015

(54) APPARATUS AND METHOD FOR DETERMINING BIT RATE FOR AUDIO CONTENT

(71) Applicant: Samsung Electronics Co., Ltd., Suwon-si, Gyeonggi-do (KR)

(72) Inventor: Chang-Joon Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 398 days.

(21) Appl. No.: 13/684,386

(22) Filed: Nov. 23, 2012

(65) Prior Publication Data

US 2013/0138445 A1 May 30, 2013

(30) Foreign Application Priority Data

Nov. 30, 2011 (KR) ..... 10-2011-0126535

(51) Int. Cl.
*G10L 19/00* (2013.01)
*G10L 19/16* (2013.01)
*G10L 19/24* (2013.01)

(52) U.S. Cl.
CPC ..... *G10L 19/00* (2013.01); *G10L 19/167* (2013.01); *G10L 19/24* (2013.01)

(58) Field of Classification Search
CPC . H04N 19/124; H04N 19/159; H04N 19/103; H04N 19/032; H04N 21/23424; H04N 21/04; H03M 7/40
USPC ..... 704/500, 273, 262, 229, 219; 709/247; 386/323; 375/240.23, 240.03, 240.02; 370/442, 338; 341/51
See application file for complete search history.

(56) References Cited

U.S. PATENT DOCUMENTS

| | | | | |
|---|---|---|---|---|
| 5,253,054 | A * | 10/1993 | Fujiwara et al. | 375/240.23 |
| 5,612,900 | A * | 3/1997 | Azadegan et al. | 709/247 |
| 5,826,231 | A * | 10/1998 | Vigier | 704/262 |
| 7,254,533 | B1 * | 8/2007 | Jabri et al. | 704/219 |
| 7,317,759 | B1 * | 1/2008 | Turaga et al. | 375/240.01 |
| 8,217,811 | B2 * | 7/2012 | Hargreaves et al. | 341/51 |
| 8,326,619 | B2 * | 12/2012 | Zavarehei et al. | 704/229 |
| 8,913,658 | B2 * | 12/2014 | Tripathi et al. | 375/240.03 |
| 2002/0057709 | A1 * | 5/2002 | Edmon et al. | 370/442 |
| 2002/0196714 | A1 * | 12/2002 | Tada et al. | 369/30.12 |
| 2003/0031251 | A1 * | 2/2003 | Koto | 375/240.03 |
| 2003/0072289 | A1 * | 4/2003 | Yuang et al. | 370/338 |
| 2003/0158737 | A1 * | 8/2003 | Csicsatka | 704/273 |
| 2005/0013585 | A1 * | 1/2005 | Ono | 386/46 |
| 2005/0055201 | A1 * | 3/2005 | Florencio et al. | 704/214 |
| 2006/0045180 | A1 * | 3/2006 | Ghanbari et al. | 375/240.03 |
| 2009/0240357 | A1 | 9/2009 | Kuo et al. | |
| 2009/0244289 | A1 * | 10/2009 | Raake et al. | 348/180 |
| 2010/0061448 | A1 * | 3/2010 | Zhou et al. | 375/240.03 |
| 2010/0318368 | A1 * | 12/2010 | Thumpudi et al. | 704/500 |
| 2012/0263241 | A1 * | 10/2012 | Swenson et al. | 375/240.26 |
| 2012/0269259 | A1 * | 10/2012 | Sauer et al. | 375/240.02 |

* cited by examiner

*Primary Examiner* — Michael Colucci
(74) *Attorney, Agent, or Firm* — Jefferson IP Law, LLP

(57) ABSTRACT

An apparatus and a method for determining a bit rate of audio content, and more particularly, an audio content bit rate determining apparatus and a method capable of quickly and correctly identifying audio content compressed at a constant bit rate from among audio content compressed at a variable bit rate and a constant bit rate, are provided. The apparatus includes a first bit rate determiner for determining a bit rate type of audio content having frames with the same frame size by skipping a predetermined number of frames with respect to the audio content, and a second bit rate determiner for determining a bit rate type of audio content having frames with different frame sizes by skipping a predetermined number of frames with respect to the audio content.

19 Claims, 4 Drawing Sheets

APPARATUS AND METHOD FOR DETERMINING BIT RATE FOR AUDIO CONTENT

CROSS-REFERENCE TO RELATED PATENT APPLICATION

This application claims the benefit under 35 U.S.C. §119 (a) of a Korean patent application filed in the Korean Intellectual Property Office on Nov. 30, 2011 and assigned Serial No. 10-2011-0126535, the entire disclosure of which is hereby incorporated reference.

BACKGROUND OF THE INVENTION

1. Field of the Invention

The present invention relates to an apparatus and method for determining a bit rate of audio content. More particularly, the present invention relates to an audio content bit rate determining apparatus and method capable of quickly and correctly identifying audio content compressed at a constant bit rate from among pieces of audio content compressed at a variable bit rate and the constant bit rate.

2. Description of the Related Art

The development and launching of portable audio devices have contributed to the quick spread in the use of MPEG Audio Layer-3 (MP3) files.

An MP3 compression scheme may adjust a bit rate in data transmission to obtain an excellent compression ratio while sound quality decreases. An MP3 format represents audio data as a sequence of frames, each frame having an independent bit rate. Each of the frames may have the same bit rate (Constant Bit Rate (CBR)) or a different bit rate (Variable Bit Rate (VBR)).

Since bit rates of audio frames of data compressed at a VBR are not constant, the bit rates of all of the audio frames should be identified to correctly obtain an average bit rate and a play time of the data. Because of this, the bit rate is important for acquiring audio information, such as a play time, or seeking for a song section to determine whether audio content, such as an MP3 file, has been compressed at a CBR or a VBR.

Accordingly, if the determination is not performed quickly, a method used for audio content compressed at a VBR should be used as well even for audio content compressed at a CBR that dominates most audio content, so an overhead is very large.

A very large overhead is consumed to distinguish a CBR from a VBR for play time information or seeking regardless of the fact that most pieces of audio content are compressed at a VBR. This causes a number of problems with popularization of smart phones having music playback functions, because a lot of resources and time are required for data scanning (e.g., an Android media scanning service, etc.) and management, as an amount of data to be managed increases in a geometric series. As a result, a song section seeking method is also based on a trial and error method for repeatedly seeking for a syncword at an incorrect position.

SUMMARY OF THE INVENTION

Aspects of the present invention are to address at least the above-mentioned problems and/or disadvantages and to provide at least the advantages described below. Accordingly, an aspect of the present invention is to provide an audio content bit rate determining apparatus and method capable of quickly and correctly identifying audio content compressed at a constant bit rate (CBR) from among pieces of audio content compressed at a variable bit rate (VBR) and the CBR.

Another aspect of the present invention is to provide an audio content bit rate determining apparatus and method capable of improving a media scanning speed for extraction of metadata by quickly identifying audio content compressed at a CBR to quickly extract information such as a play time.

Another aspect of the present invention is to provide an audio content bit rate determining apparatus and method capable of increasing an accuracy and speed in seeking for a song section of audio content by quickly finding a correct frame position in the seeking by quickly identifying audio content compressed at a CBR.

According to an aspect of the present invention, an apparatus for determining a bit rate of audio content is provided. The apparatus includes a first bit rate determiner for determining a bit rate type of audio content having frames with the same frame size by skipping a predetermined number of frames with respect to the audio content, and a second bit rate determiner for determining a bit rate type of audio content having frames with different frame sizes by skipping a predetermined number of frames with respect to the audio content.

According to another aspect of the present invention, a method of determining a bit rate of audio content is provided. The method includes determining whether the frames of the audio content have the same frame size, if the frames of the audio content have the same frame size, determining a bit rate type of the audio content by skipping a predetermined number of frames with respect to the audio content, and if the frames of audio content do not have the same frame size, determining a bit rate type of the audio content by skipping a predetermined number of frames with respect to the audio content.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will become more apparent from the following description taken in conjunction with the accompanying drawing in which.

Throughout the drawings, it should be noted that like reference numbers are used to depict the same or similar elements, features, and structures.

DETAILED DESCRIPTION OF THE PREFERRED EMBODIMENT

The following description with reference to the accompanying drawings is provided to assist in a comprehensive understanding of exemplary embodiments of the invention as defined by the claims and their equivalents. It includes various specific details to assist in that understanding, but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but are merely used by the inventor to enable a clear and consistent understanding of the invention. Accordingly, it should be apparent to those skilled in the art that the following description of exemplary embodiments of the present invention is provided for illustration purposes only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
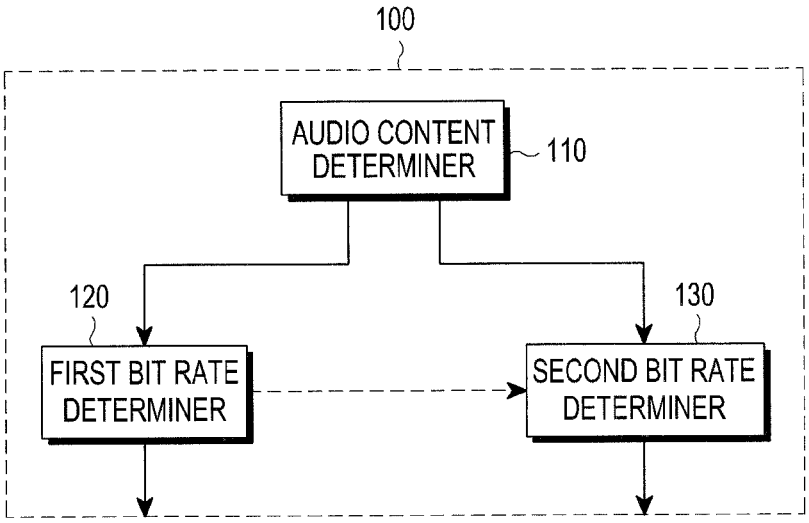
FIG. 1 is a block diagram of an apparatus for determining a bit rate of audio content according to an exemplary embodiment of the present invention.

FIG. 1 is a block diagram of an apparatus for determining a bit rate of audio content according to an exemplary embodiment of the present invention.

Referring to FIG. 1, the apparatus 100 may include an audio content determiner 110, a first bit rate determiner 120, and a second bit rate determiner 130. The apparatus 100 may be a part of a desktop computer, laptop computer, smartphone, personal digital assistant, or the like.

The audio content determiner 110 determines whether the audio content has the same frame size based on sampling rate information of audio content.

If it is determined based on the sampling rate information of the audio content that the audio content has the same frame size without any padding bytes, the audio content determiner 110 transmits the audio content to the first bit rate determiner 120. For example, when the sampling rate information of the audio content includes 32,000 Hz or 48,000 Hz, the audio content determiner 110 may determine that the audio content has the same frame size without any padding byte.

If it is determined based on the sampling rate information of the audio content that the audio content has different frame sizes with padding bytes, the audio content determiner 110 transmits the audio content to the second bit rate determiner 130. For example, when the sampling rate information of the audio content includes 44,100 Hz, 22,050 Hz, and 11,025 Hz, the audio content determiner 110 may determine that the audio content has different frame sizes with padding bytes.

The first bit rate determiner 120 determines a bit rate type of the audio content by skipping a predetermined number of frames with respect to the audio content having the same frame size that is received from the audio content determiner 110. When the audio content having the same frame size is received from the audio content determiner 110, if a frame header or a syncword included in the frame header is detected after bytes corresponding to a predetermined frame size×a predetermined number of frames are skipped with respect to the audio content, the first bit rate determiner 120 determines the audio content as audio content compressed at a CBR.

Otherwise, if a frame header or a syncword included in the frame header is not detected after bytes corresponding to the predetermined frame size×the predetermined number of frames are skipped with respect to the audio content, the first bit rate determiner 120 may determine the audio content as audio content compressed at a VBR.

The second bit rate determiner 130 determines a bit rate type of the audio content by skipping a predetermined number of frames with respect to the audio content having different frame sizes that is received from the audio content determiner 110.

When the audio content having the different frame sizes is received from the audio content determiner 110, if a frame header or a syncword included in the frame header is detected after bytes corresponding to an M-frame size (P bytes) having periodicity of padding-byte insertion at every M-frame unit×a predetermined integer N are skipped with respect to the audio content, the second bit rate determiner 130 determines the audio content as audio content compressed at a CBR.

Otherwise, if a frame header or a syncword included in the frame header is not detected after bytes corresponding to the M-frame size (P bytes) having periodicity of padding-byte insertion at every M-frame unit×the predetermined integer N are skipped with respect to the audio content, the second bit rate determiner 130 may determine the audio content as audio content compressed at a VBR.

According to another exemplary embodiment of the present invention, the apparatus 100 may include only the first bit rate determiner 120 and the second bit rate determiner 130. In this case, the first bit rate determiner 120 may analyze the audio content, and, depending on the result of the analysis, the second bit rate determiner may analyze the audio content.

If a frame header or a syncword included in the frame header is detected after a predetermined number of frames are skipped with respect to audio content, the first bit rate determiner 120 determines the audio content as audio content compressed at a CBR.

If a frame header or a syncword included in the frame header is detected after bytes corresponding to a predetermined frame size×a predetermined number of frames are skipped with respect to the audio content, the first bit rate determiner 120 determines the audio content as audio content compressed at a CBR.

Otherwise, if a frame header or a syncword included in the frame header is not detected after bytes corresponding to the predetermined frame size×the predetermined number of frames are skipped with respect to the audio content, the first bit rate determiner 120 transmits the audio content to the second bit rate determiner 130.

If a frame header or a syncword included in the frame header is detected after bytes corresponding to an M-frame size (P bytes) having periodicity of padding-byte insertion at every M-frame unit×a predetermined integer N are skipped with respect to the audio content received from the first bit rate determiner 120, the second bit rate determiner 130 determines the audio content as audio content compressed at a CBR.

Otherwise, if a frame header or a syncword included in the frame header is not detected after bytes corresponding to the M-frame size (P bytes) having periodicity of padding-byte insertion at every M-frame unit×the predetermined integer N are skipped with respect to the audio content received from the first bit rate determiner 120, the second bit rate determiner 130 may determine the audio content as audio content compressed at a VBR.

An operation of determining a bit rate of audio content in the apparatus 100 is described below with reference to FIGS. 2 to 4B.

Figure 2:
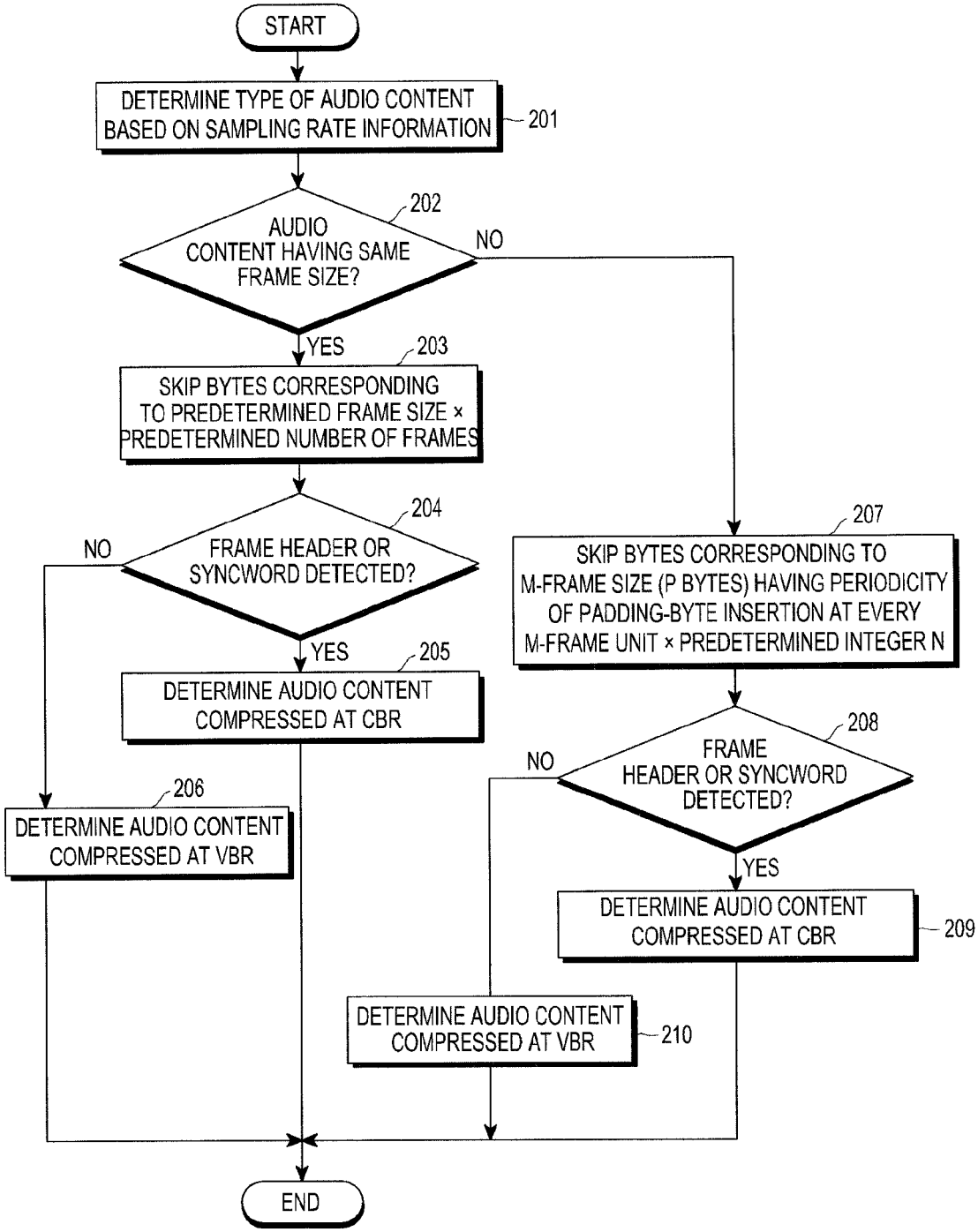
FIG. 2 is a flowchart illustrating a process of determining a bit rate of audio content according to an exemplary embodiment of the present invention.

FIG. 2 is a flowchart illustrating a process of determining a bit rate of audio content according to an exemplary embodiment of the present invention. This embodiment is described with reference to the apparatus 100 shown in FIG. 1.

Referring to FIG. 2, in step 201, the audio content determiner 110 determines a type of audio content based on sampling rate information of the audio content.

If the audio content determiner 110 determines based on the sampling rate information of the audio content that the audio content has the same frame size, such as 32,000 Hz or 48,000 Hz, in step 202, the audio content determiner 110 transmits the audio content having the same frame size to the first bit rate determiner 120.

In step 203, the first bit rate determiner 120 skips bytes corresponding to a predetermined frame size×a predetermined number of frames with respect to the audio content that is received from the audio content determiner 110.

If a frame header or a syncword included in the frame header is detected in step 204, the first bit rate determiner 120 determines the audio content as audio content compressed at a CBR in step 205. Otherwise, if a frame header or a syncword included in the frame header is not detected in step 204, the first bit rate determiner 120 determines the audio content as audio content compressed at a VBR in step 206.

Figure 4A:
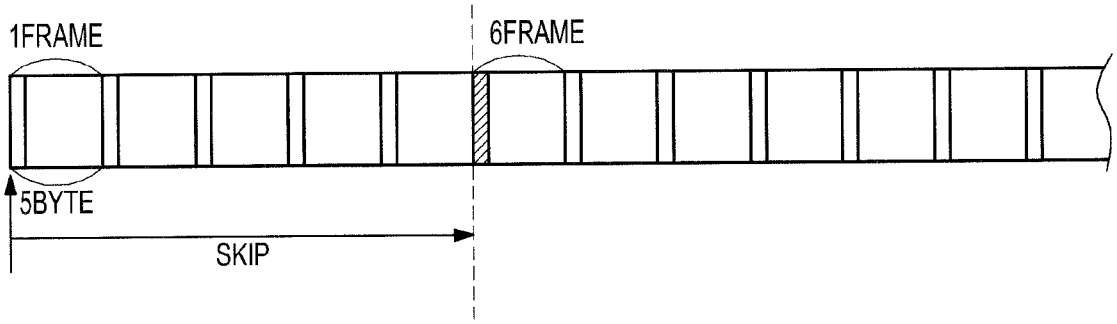
FIG. 4A illustrates a plurality of frames of audio content having the same frame size according to an exemplary embodiment of the present invention.

FIG. 4A illustrates a plurality of frames of audio content having the same frame size according to an exemplary embodiment of the present invention.

Referring to FIG. 4A, when the first bit rate determiner 120 receives audio content having the same frame size as shown in FIG. 4A, if a $6^{th}$ frame header or a syncword included in the 6th frame header is detected after 20 bytes obtained by multiplying a predetermined frame size, e.g., 5 bytes that are a size of a first frame, by a predetermined number of frames, i.e., 4, are skipped, the first bit rate determiner 120 may determine the audio content as audio content compressed at a CBR.

If the audio content determiner 110 determines based on the sampling rate information of the audio content that the audio content has different frame sizes, such as 44,100 Hz, 22,050 Hz, and 11,025 Hz, in step 202, the audio content determiner 110 transmits the audio content having different frame sizes to the second bit rate determiner 130.

In step 207, the second bit rate determiner 130 skips bytes corresponding to an M-frame size (P bytes) having periodicity of padding-byte insertion at every M-frame unit×a predetermined integer N are skipped with respect to the audio content that is received from the audio content determiner 110.

If a frame header or a syncword included in the frame header is detected in step 208, the second bit rate determiner 130 determines the audio content as audio content compressed at a CBR in step 209. Otherwise, if a frame header or a syncword included in the frame header is not detected in step 208, the second bit rate determiner 130 determines the audio content as audio content compressed at a VBR in step 210.

Figure 4B:
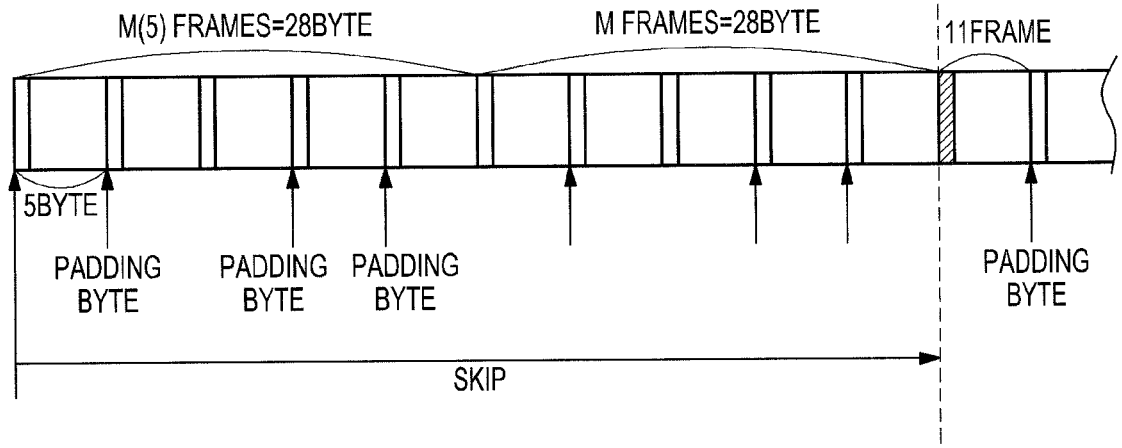
FIG. 4B illustrates a plurality of frames of audio content having different frame sizes according to an exemplary embodiment of the present invention.

FIG. 4B illustrates a plurality of frames of audio content having different frame sizes according to an exemplary embodiment of the present invention.

Referring to FIG. 4B, in a case of audio content having different frame sizes, e.g., audio content such as 44,100 Hz, 22,050 Hz, and 11,025 Hz, padding bytes may be inserted between frames to match a bit rate, causing each frame size to be changed. As a result of analysis of an algorithm for audio content with padding bytes inserted therein, the insertion of padding bytes has been determined to have periodicity on an M-frame basis.

As shown in FIG. 4B, padding bytes are inserted at a periodicity of 5 frames. Accordingly, when the second bit rate determiner 130 receives audio content having different frame sizes as shown in FIG. 4B, if an eleventh frame header or a syncword included in the eleventh frame header is detected after 56 bytes obtained by multiplying an M-frame size (P=28) bytes) having periodicity of padding-byte insertion at every M-frame unit (e.g., 5)×a predetermined integer N (e.g., 2) are skipped with respect to the audio content, the second bit rate determiner 130 determines the audio content as audio content compressed at a CBR.

The P bytes corresponding to the M-frame size is calculated by an expression "1-frame size (5 bytes)×the number (5) of frames included in an M-frame unit+padding bytes (3 bytes) inserted into the M-frame unit".

Figure 3:
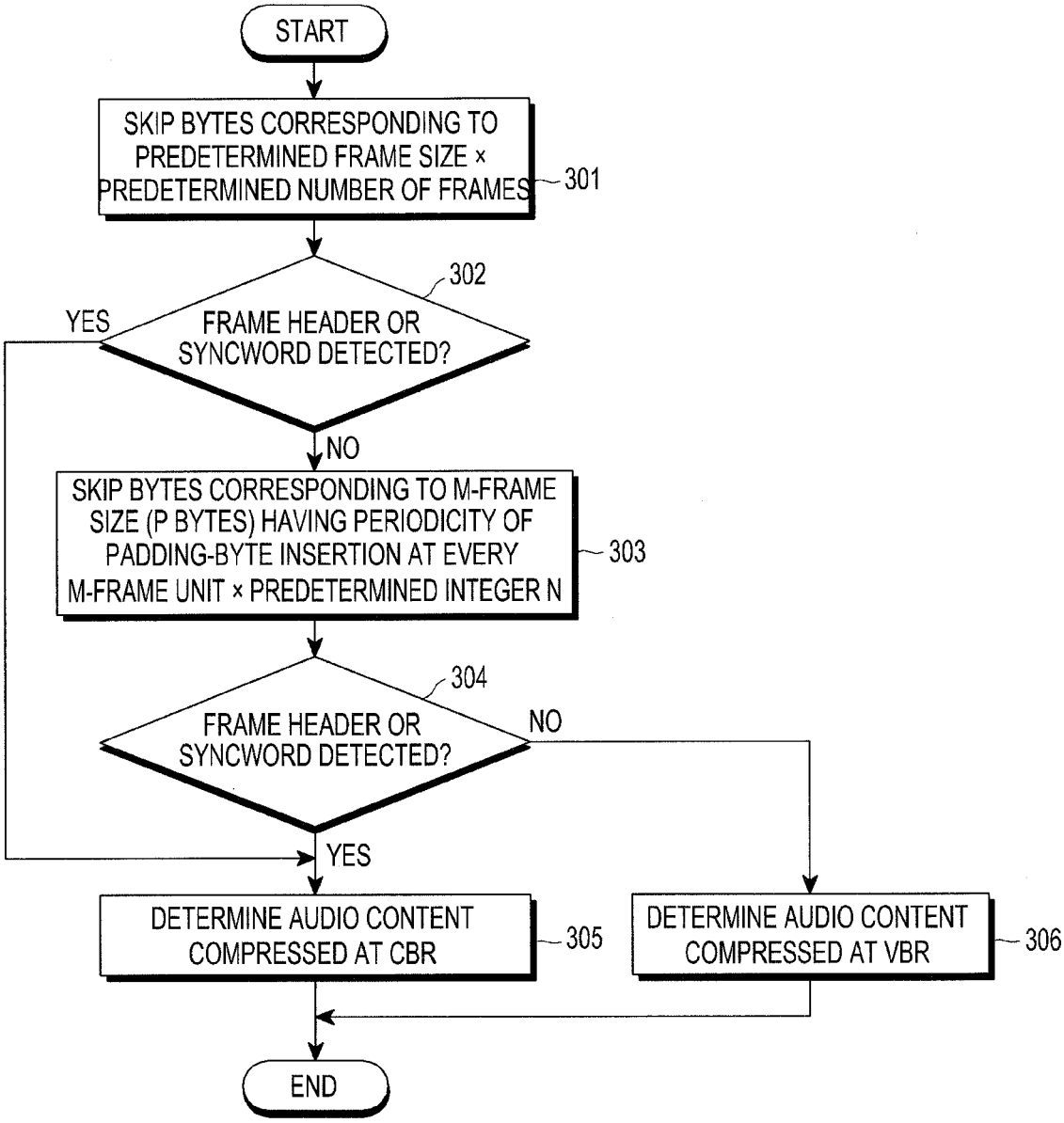
FIG. 3 is a flowchart illustrating a process of determining a bit rate of audio content according to another exemplary embodiment of the present invention.

FIG. 3 is a flowchart illustrating a process of determining a bit rate of audio content according to another exemplary embodiment of the present invention. This embodiment is described with reference to the apparatus 100 shown in FIG. 1.

Referring to FIG. 3, in step 301, the first bit rate determiner 120 skips bytes corresponding to a predetermined frame size×a predetermined number of frames with respect to audio content.

If a frame header or a syncword included in the frame header is detected in step 302, the first bit rate determiner 120 determines the audio content as audio content compressed at a CBR in step 305. Otherwise, if a frame header or a syncword included in the frame header is not detected in step 302, the first bit rate determiner 120 transmits the audio content to the second bit rate determiner 130. A method of determining in the first bit rate determiner 120 whether the audio content is compressed at a CBR is similar to the method shown in FIG. 2.

In step 303, the second bit rate determiner 130 skips bytes corresponding to an M-frame size (P bytes) having periodicity of padding-byte insertion at every M-frame unit×a predetermined integer N with respect to the audio content received from the first bit rate determiner 120.

If a frame header or a syncword included in the frame header is detected in step 304, the second bit rate determiner 130 determines the audio content as audio content compressed at a CBR in step 305. Otherwise, if a frame header or a syncword included in the frame header is not detected in step 304, the second bit rate determiner 130 determines the audio content as audio content compressed at a VBR in step 306.

Referring to FIGS. 2 and 3, audio content compressed at a CBR may be quickly determined with little overhead in computation by performing only a comparison operation after one skip operation. In addition, if it is determined that audio content is compressed at a CBR, direct seeking to a correct start position of a frame may be possible by predicting the start position based on the CBR to seek for a song section by corresponding bytes.

As is apparent from the foregoing description, an apparatus and method for determining a bit rate of audio content according to an exemplary embodiment of the present invention allows audio content compressed at a CBR to be quickly and correctly identified from among audio content compressed at a VBR and a CBR. In addition, a media scanning speed for extraction of metadata can be significantly improved by quickly identifying audio content compressed at a CBR to quickly extract information such as a play time. In addition, an accuracy and speed in seeking for a song section of audio content can increase by quickly identifying audio content compressed at a CBR.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A computing device comprising an apparatus for determining a bit rate of audio content, the computing device comprising:

a first bit rate determiner for determining a bit rate type of audio content having frames with the same frame size by skipping a predetermined number of frames with respect to the audio content; and a second bit rate determiner for determining a bit rate type of audio content having frames with different frame sizes by skipping a predetermined number of frames with respect to the audio content.

2. The computing device of claim 1, further comprising an audio content determiner for determining whether the audio content has frames with the same frame size based on sampling rate information of the audio content.

3. The computing device of claim 2, wherein the audio content determiner transmits the audio content to the first bit rate determiner if it is determined based on the sampling rate information that the audio content is audio content having frames with the same frame size without any padding byte, and wherein the audio content determiner transmits the audio content to the second bit rate determiner if it is determined based on the sampling rate information that the audio content is audio content having frames with different frame sizes with padding bytes inserted therein.

4. The computing device of claim 1, wherein the first bit rate determiner determines the audio content as audio content compressed at a Constant Bit Rate (CBR), if a frame header is detected after bytes corresponding to a predetermined frame size×a predetermined number of frames are skipped with respect to the audio content having frames with the same frame size.

5. The computing device of claim 4, wherein the first bit rate determiner determines the audio content as audio content compressed at a Variable Bit Rate (VBR), if the frame header is not detected after bytes corresponding to a predetermined frame size×a predetermined number of frames are skipped with respect to the audio content having frames with the same frame size.

6. The computing device of claim 1, wherein the second bit rate determiner determines the audio content as audio content compressed at a CBR, if a frame header is detected after bytes corresponding to an M-frame size (P bytes) having periodicity of padding-byte insertion at every M-frame unit×a predetermined integer N are skipped with respect to the audio content having frames with different frame sizes.

7. The computing device of claim 6, wherein the second bit rate determiner determines the audio content as audio content compressed at a VBR, if the frame header is not detected after the bytes are skipped with respect to the audio content having frames with different frame sizes.

8. The computing device of claim 1, wherein the first bit rate determiner determines the audio content as audio content compressed at a CBR, if a frame header is detected after a predetermined number of frames are skipped with respect to the audio content, and the first bit rate determiner transmits the audio content to the second bit rate determiner, if a frame header is not detected.

9. The computing device of claim 8, wherein the first bit rate determiner determines the audio content as audio content compressed at a CBR, if a frame header is detected after bytes corresponding to a predetermined frame size×a predetermined number of frames are skipped with respect to the audio content.

10. The computing device of claim 8, wherein the second bit rate determiner determines the audio content as audio content compressed at a CBR, if a frame header is detected after a predetermined frame unit is skipped with respect to the audio content.

11. The computing device of claim 10, wherein the second bit rate determiner determines the audio content as audio content compressed at a CBR, if a frame header is detected after bytes corresponding to an M-frame size (P bytes) having periodicity of padding-byte insertion at every M-frame unit×a predetermined integer N are skipped with respect to the audio content.

12. A method of determining a bit rate of audio content, the method comprising:

determining whether frames of the audio content have the same frame size;

if the frames of the audio content have the same frame size, determining a bit rate type of the audio content by skipping a predetermined number of frames with respect to the audio content; and if the frames of the audio content do not have the same frame size, determining a bit rate type of the audio content by skipping a predetermined number of frames with respect to the audio content.

13. The method of claim 12, wherein the determining of whether the audio content has frames with the same frame size comprises determining, based on sampling rate information of the audio content, whether the audio content is audio content having frames with the same frame size without any padding byte or audio content having frames with different frame sizes with padding bytes inserted therein.

14. The method of claim 12, wherein the determining of the bit rate type of the audio content having frames with the same frame size comprises:

skipping bytes corresponding to a predetermined frame size×a predetermined number of frames; and if a frame header is detected after skipping the bytes, determining the audio content as audio content compressed at a Constant Bit Rate (CBR).

15. The method of claim 12, wherein the determining of the bit rate type of the audio content having frames with the same frame size comprises:

skipping bytes corresponding to an M-frame size (P bytes) having periodicity of padding-byte insertion at every M-frame unit×a predetermined integer N; and if a frame header is detected after the skipping, determining the audio content as audio content compressed at a CBR.

16. The method of claim 12, further comprising;

if a frame header is detected after a predetermined number of frames are skipped with respect to the audio content, determining the audio content as audio content compressed at a CBR;

if a frame header is not detected after the skipping, skipping a predetermined frame unit with respect to the audio content; and if a frame header is detected after skipping the predetermined frame unit, determining the audio content as audio content compressed at a CBR.

17. The method of claim 16, further comprising determining the audio content as audio content compressed at a CBR, if a frame header is detected after bytes corresponding to a predetermined frame size×a predetermined number of frames are skipped with respect to the audio content.

18. The method of claim 16, further comprising determining the audio content as audio content compressed at a CBR, if a frame header is detected after bytes corresponding to an M-frame size (P bytes) having periodicity of padding-byte insertion at every M-frame unit×a predetermined integer N are skipped with respect to the audio content.

19. The method of claim 16, further comprising determining the audio content as audio content compressed at a Variable Bit Rate (VBR) if the frame header is not detected after skipping the predetermined frame unit.

* * * * *